US006817609B2

(12) United States Patent
Halvonik et al.

(10) Patent No.: US 6,817,609 B2
(45) Date of Patent: Nov. 16, 2004

(54) PRINTER SHEET LATERAL REGISTRATION SYSTEM WITH AUTOMATIC UPSTREAM NIP DISENGAGEMENTS FOR DIFFERENT SHEET SIZE

(75) Inventors: Mark R. Halvonik, Rochester, NY (US); Douglas K. Herrmann, Webster, NY (US)

(73) Assignee: Xerox Corporation, Stamford, CT (US)

( * ) Notice: Subject to any disclaimer, the term of this patent is extended or adjusted under 35 U.S.C. 154(b) by 116 days.

(21) Appl. No.: 10/267,713

(22) Filed: Oct. 8, 2002

(65) Prior Publication Data

US 2004/0065994 A1 Apr. 8, 2004

(51) Int. Cl.[7] ..... B65H 7/02
(52) U.S. Cl. ..... 271/228; 271/227; 271/259
(58) Field of Search ..... 271/227, 228, 271/226, 259, 265.01, 265.02

(56) References Cited

U.S. PATENT DOCUMENTS 4,621,801 A 11/1986 Sanchez
4,929,128 A 5/1990 Affleck
5,078,384 A 1/1992 Moore
5,449,165 A 9/1995 Naramore
5,577,719 A * 11/1996 Nicoll ..... 271/227
6,168,153 B1 1/2001 Richards et al.

* cited by examiner

*Primary Examiner*—Donald P. Walsh
*Assistant Examiner*—Kaitlin Joerger

(57) ABSTRACT

A sheet registration system for a sheet transport path of a reproduction apparatus providing positive feeding yet lateral registration of a wide range of different image substrate sheets. Independent sheet transport units with plural radius sheet feed rollers spaced along the sheet transport path engage sheets being fed to provide positive feeding of even very short sheets from one sheet transport unit to another, yet provide automatic opening of the nips of selected units to allow lateral registration movement of even a very long sheet in the downstream lateral sheet registration system. The same drive motor rotatably driving each sheet transport unit is controlled in rotational position to selectively open the number of open sheet feeding nips needed for the lateral registration movement of that particular sheet length. The mating idlers for the sheet feed rollers need not be moved to open the nips.

6 Claims, 2 Drawing Sheets

Figure 1:
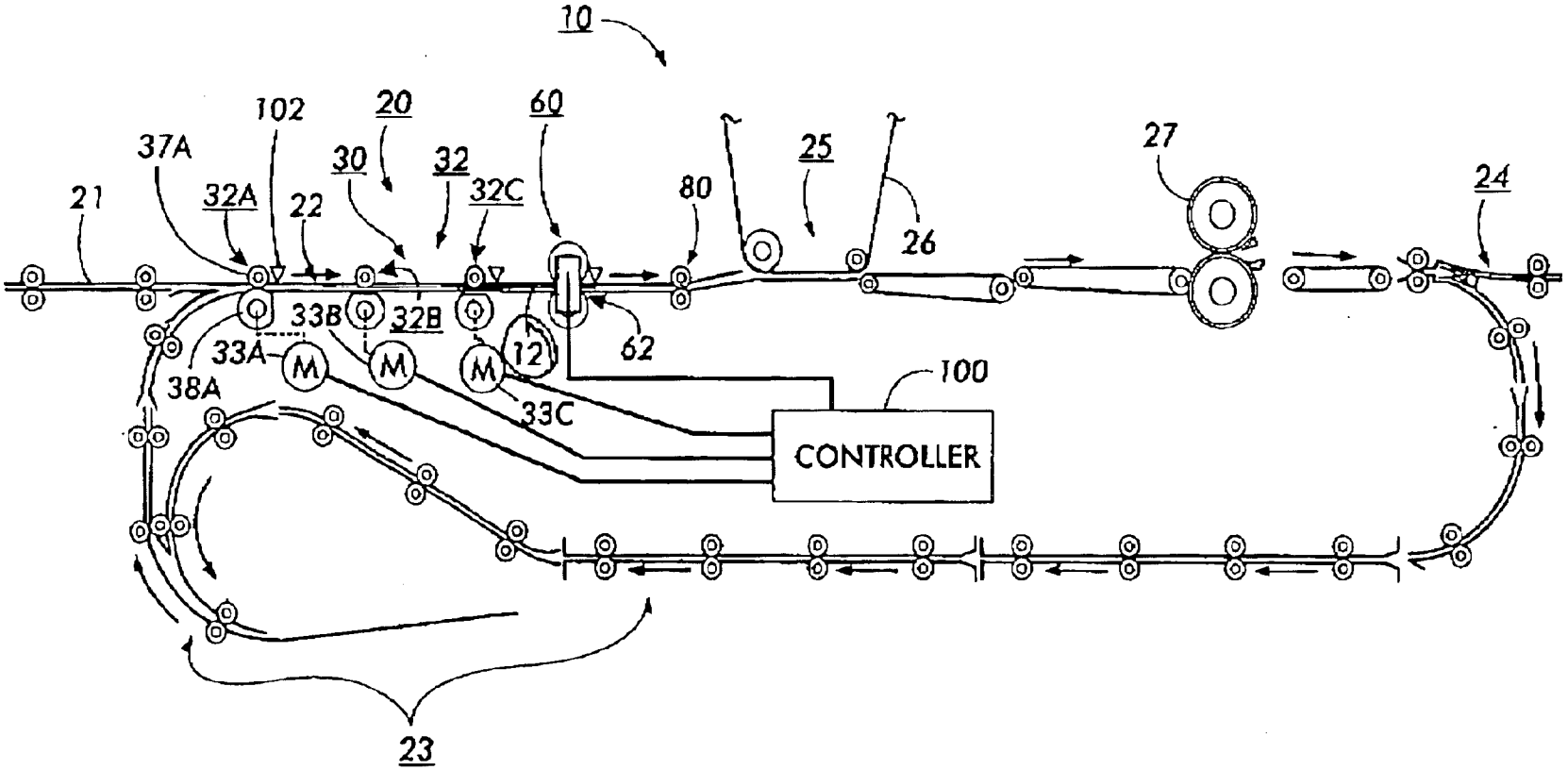

PRINTER SHEET LATERAL REGISTRATION SYSTEM WITH AUTOMATIC UPSTREAM NIP DISENGAGEMENTS FOR DIFFERENT SHEET SIZE

Cross-referenced is U.S. patent application Ser. No. 10/237,362 filed Sep. 6, 2002 by the same inventors, and having the same assignee, entitled "Printer Lateral and Deskew Sheet Registration System."

In the exemplary and various other sheet handling devices and systems, accurate registration of the sheets is accomplished through various mechanisms and methods which require normal sheet feeding nips to open. Upon opening the sheet feeding nips, the sheet is released therefrom so that a sheet registration device is able to orient the paper. In previous designs, relatively complex and expensive solenoid driven or stepper motor driven mechanisms typically accomplished these nip openings by mechanical movement of idlers away from their drive rolls. The system and method of the disclosed embodiment eliminates such complex and expensive mechanisms associated with previous nip opening systems.

The disclosed embodiment is also an improvement over the system and method of Xerox Corp. U.S. Pat. No. 6,168,153 issued Jan. 2, 2001 to Paul N. Richards, et al, and others cited herein.

With the specific embodiment disclosed herein, a separate motor or solenoid is not required to open the upstream paper path sheet feed roller nips by moving the idlers away to allow for longer sheet deskewing and/or side registration (lateral registration) in the downstream sheet lateral registration system. The same stepper or servo motor that is used for driving the sheet feed rollers can be used. It can be simply controlled in its rotational position to selectively hold open the upstream sheet feeding nips that need to be held open for the deskewing and/or side registration of that particular sheet. Also, the mating idlers can be conventionally fixedly mounted (for further cost reductions).

This is enabled in this disclosed embodiment by larger circumference sheet feed rollers having at least two different radii (which for simplicity of description may be referred to herein as "D" rollers). Plural sets of these upstream "D" feed rollers selectively provide, with selected partial rotations, either normal sheet feeding nips or open nips allowing unobstructed variable size sheet lateral movement therein by the downstream sheet lateral registration system yet positive sheet feeding and control.

Further by way of background, various sheet lateral registration systems are known in the art, and the present system is not limited to any particular sheet deskew and/or side-shifting system. The above-cited U.S. Pat. No. 6,168,153 shows one type. The specific example schematically shown herein is one of various known TELER systems of sheet registration, which also have differential roll pair driving for sheet deskew, and in which sheet side-shifting is also provided. The sheet lateral (side-shift) registration may be accomplished in a TELER system by side-shifting the TELER sheet drive rolls and their associated components while the sheet is engaged in the feed nip of those TELER sheet drive rolls. That sheet side-shifting can provide lateral sheet registration in a known manner, as by a carriage containing the two drive rollers, and their opposing nip idlers, being axially side-shifted to side-shift a nip-engaged sheet into lateral registration. Sheet process direction registration can also be provided by the controlled common forward driving rotational velocity of the same pair of rollers.

Examples of such TELER systems include U.S. Pat. No. 5,094,442, issued Mar. 10, 1992 to Kamprath et al; U.S. Pat. Nos. 5,794,176 and 5,848,344 to Milillo et al; U.S. Pat. No. 5,219,159, issued Jun. 15, 1993 to Malachowski and Kluger (citing numerous other patents); U.S. Pat. No. 5,337,133; and other cited patents. Of interest is a Xerox Corp. U.S. Pat. No. 5,278,624, issued Jan. 11, 1994 to David R. Kamprath and Martin E. Hoover, showing another example of a TELER type of combined lateral sheet registration and deskewing system for a printer, but with only a single drive motor and reduced mass of the TELER lateral translation (side shifting) components. Reduced mass is helpful both for allowing more rapid or lower power side-shifting and the re-centering or return to a "home" position of TELER systems. Heretofore the latter has been done in the very short time and space available only between successive sheets in the sheet path of a high speed printer, i.e., when no sheet is in the nip of the TELER system.

Of particular background interest is a Xerox Corp. U.S. Pat. No. 5,078,384 issued Jan. 7, 1992 to Steven R. Moore. This is not a TELER system. Rather, it accomplishes sheet deskewing and downstream or forward direction registration by differential driving of two sheet drive rolls 24, 25, by two servomotors, but does not provide sheet lateral (sideways) registration by any side-shifting of those drive rolls. Thus, it does not teach or suggest (or even have the problem of) accomplishing rapid re-centering of a TELER system in between operative sheet nip engagements. However, this U.S. Pat. No. 5,078,384 does show the use of "D" shaped (partially relieved radius) drive rolls 24,25 to disengage those drive rolls from the sheet (opening the drive nip) when those drive rolls are rotated to the position in which the reduced radius or "flat" portion of those "D" shaped drive rolls is facing the sheet and becomes spaced therefrom due it the reduced radius of that portion of the roll.

"D" shaped sheet feeding rolls are, of course, used in various other paper sheet feeding applications. For example, Xerox Corp. U.S. Pat. No. 5,449,165, issued Sep. 12, 1995, discloses a 90 degree paper feed transition module with transversely mounted and intermittently rotated "D" shaped feed rolls. Xerox Corp. U.S. Pat. No. 4,929,128, issued May 22, 1990 to Stemmle, shows typical segmented or "D" shaped feed rolls for initial sheet feeding, and for duplex path sheet feeding. However, the present embodiment provides normal and even closed nip sheet nip engagement and feeding, unlike such "D" roller sheet feed systems in which a stationary sheet is unevenly accelerated by initial engagement of a "corner" of the "D" roller (where the "D" roller transitions from it's smaller to it's larger radius) with the sheet.

Disclosed in the embodiment herein is an improved system for controlling, correcting and/or changing the position of sheets traveling in a sheet transport path, in particular, for rapid automatic sheet skew correction and/or side registration of a wider range of different sizes of paper or other print media sheets in or for an image reproduction apparatus, such as a high speed electronic printer, to provide deskewing and/or side registration of much longer sheets without losing positive sheet feeding control over much shorter sheets, including subsequently fed sheets in the sequence of sheets in the sheet path. This may include deskewing and/or side registration of sheets being initially fed in to be printed, sheets being recirculated for second side (duplex) printing, and/or sheets being outputted to a stacker, finisher or other output or module.

More specifically disclosed in the embodiment herein is an improved system and method for automatically engaging and disengaging an appropriate number of sequential plural spaced sheet feed-in nips of the sheet transport in the sheet path into the sheet deskewing system in accordance with a control signal corresponding to the length of the sheet to be laterally registered. The sheet "length" here is the sheet dimension in the sheet feeding or sheet movement direction of the sheet path, otherwise known as the "process direction," as such terms may be used in the art in that regard, even though, as is well known, smaller sheets are often fed "long edge first," rather than lengthwise, whereas in contrast very large sheets are more often fed lengthwise. Sheet "width" as referred to herein is thus the orthogonal sheet dimension as the sheet is being fed, i.e., the sheet dimension transverse to the sheet path and the sheet movement direction.

As shown in the embodiment example, these features and improvements can be accomplished in one exemplary manner by automatically disengaging a long sheet being deskewed in a sufficient sequential number of upstream sheet feeding units to allow the deskewing of that long sheet, the number of units being disengaged depending on the length of the sheet. Yet positive nip feeding engagement of the next adjacent upstream sheet being fed can be simultaneously maintained in engaged sheet feeding units while the closely immediately preceding sheet is being deskewed, even for very short sheets.

As shown in this example, the selectable nip openings of otherwise closed sheet feeding units may be simply and reliably provided by a variable control system for the same servo or stepper drive motors driving the respective plural sheet feeding units. As further disclosed in the embodiment example, this may be provided here by controlled partial rotation of those respective drive motors, to provide reliable sheet feeding nip disengagement or engagement in each unit. The disclosed system can provide better control and reliability than trying to hold individual nips open or closed by activation, deactivation, or holding, of solenoid actuators, and does not require any additional stepper motors or servomotors.

The disclosed embodiment (or other embodiments of the generic concept) can greatly assist in automatically providing more accurate and rapid deskewing rotation and/or edge registration of a very wide range of sheet sizes, from very small sheets to very large sheets, and from thin and flimsy such sheets to heavy or stiff such sheets. This is accomplished in the disclosed embodiment by a simple, low cost, fixed position, system which does not require repositioning of any of the system components relative to the paper path, merely automatically selecting different nip openings or closings along different positions of the paper path.

The present system is well suited for cooperation and combination with an automatic deskewing and side registration system of various known types, especially those comprising a differentially driven spaced pair of sheet deskewing sheet drive rollers, for which various references are cited herein.

Examples of one such prior art type of dual differently driven nips systems for automatic deskewing and side registration of the sheets to be accurately imaged in a printer, including the appropriate controls of the differently driven sheet steering nips, and including cooperative arrayed sheet edge position detector sensors and signal generators, are already fully described and shown, for example, in Xerox Corp. U.S. Pat. Nos. 5,678,159 and 5,715,514 by Lloyd A. Williams, et al., and other patents cited therein, all of which are incorporated herein. With different nip drive velocities, the sheet can be deskewed or straightened out so that the sheet exits the steering nip pair aligned in the process direction.

The improved system disclosed herein is also desirably compatible and combinable with an elongated and substantially planer sheet feeding path upstream in the paper path from the subject deskewing and/or side registration system station, leading thereto, along which the subject sheet feeding units here are spaced. Such a long and planar sheet feeding path to the deskewing system reduces resistance to sheet rotation and/or lateral movement, especially for large, stiff, sheets. That is, a planar sheet entrance path longer than the longest sheet to be deskewed, to allow deskewing rotation of even very large and stiff sheets while those sheet are planar, rather than a path that bends sheets to cause sheet beam strength normal forces pressing against the path baffles, thus reducing any tendency for that to cause excessive resistance and/or scuffing or slippage by both the sheet feeding nips and the deskewing or steering nips.

As further disclosed in the embodiment herein, the subject improved sheet input feeding system in the upstream sheet feeding path provides for the automatic release or disengagement of a selected variable number (from 1 to 3 in the illustrated embodiment) of plural upstream sheet feeding plural nip stations or units spaced apart along the sheet path upstream of the sheet deskewing station. That selected release is automatic, and may be in response to a sheet length control signal (such as a signal from a sensor or other signal generator indicative of the approximate sheet dimension along or in the process or sheet path movement direction). The spacings and respective actuations (releases or engagements) of the selected number of plural sheet feeding nips along the upstream sheet path of that sheet path control system can provide for a wide range of sheet lengths to be positively fed, without loss of positive nip control, even short sheets, downstream to the automatic deskewing and/or side registration system. Yet once a sheet is acquired in the steering nips of the deskew system a sufficient number of said upstream sheet feeding nips can be automatically released or opened to allow for unrestrained sheet rotation and/or lateral movement by the subject system, even of very long sheets. As is well know in the art, standard sizes of larger size sheets are both longer and wider, and are often fed short-edge first or lengthwise, and thus are very long sheets in the process direction. This related cooperative automatic system also helps provide for automatic proper deskewing and/or edge registration of very small sheets, with positive feeding of even very small sheets, even with small pitch spacings and higher page per minute (PPM) rates, yet with positive feeding nip engagement of such small sheets in the same sheet input path and system as for such very large sheets.

In reference to the above, as taught, for example, in Xerox Corp. U.S. Pat. No. 4,621,801 issued Nov. 11, 1986 to Hector J. Sanchez (see especially the middle of Col. 17), it is known to release a single upstream sheet feeding nip to allow a downstream document sheet deskewing and side registration nip system to rotate (to deskew) and/or side shift the sheet. However, that only is effective for a limited range of sheet lengths. If that single releasable upstream sheet feeding nip is spaced too far away from the downstream sheet deskewing and side registration nip it cannot positively feed any sheets of lesser dimensions than that spacing. If on the other hand that single releasable upstream sheet feeding nip is spaced too far downstream it may be too far away from the next further upstream non-releasable sheet feeding nip in the sheet path. Yet if that next further upstream sheet feeding nip is positioned too far downstream it will not release the rear or trailing edge portion of long sheets in time—before the leading edge of that same long sheet is in the downstream sheet deskewing and side registration nip which is trying to rotate and/or side shift that sheet.

Another disclosed feature and advantage illustrated in the disclosed embodiments is that the plural positive sheet feeding units can all share a high number and percentage of identical or almost identical components, thus providing significant design, manufacturing, and servicing cost advantages.

The above and other features and advantages allow for accurate registration for imaging of a wider variety of image substrate sheet sizes. In reproduction apparatus in general, such as xerographic and other copiers and printers or multifunction machines, it is increasingly important to be able to provide faster yet safer and more reliable, more accurate, and more automatic, handling of a wide variety of the physical image bearing sheets, typically paper (or even plastic transparencies) of various sizes, weights, surfaces, humidity, and other conditions. Elimination of sheet skewing or other sheet misregistration is very important for proper imaging. Otherwise, borders and/or edge shadow images may appear on the copy sheet; and/or information near an edge of the image may be lost. Sheet misregistration or misfeeding can also adversely affect further sheet feeding, ejection, and/or stacking and finishing.

Further by way of background, various types of variable or active, as opposed to passive, sheet side shifting or lateral registration systems are known in the art. It is particularly desirable to be able do so "on the fly," without stopping the sheets, while the sheet is moving through or out of the reproduction system at a normal process (sheet transport) speed. In addition to the two sheet side registration systems patents cited above providing combined sheet deskewing, the following patent disclosures, and other patents cited therein are noted by way of some other examples of active sheet lateral registration systems with various means for side-shifting or laterally repositioning the sheet: Xerox Corp. U.S. Pat. No. 5,794,176 issued Aug. 11, 1998 to W. Milillo; U.S. Pat. No. 4,971,304 issued Nov. 20, 1990 to R. Lofthus; U.S. Pat. No. 5,156,391 issued Oct. 20, 1992 to G. Roller; U.S. Pat. No. 5,078,384 issued Jan. 7, 1992 to S. Moore; U.S. Pat. No. 5,094,442 issued Mar. 10, 1992 to D. Kamprath, et al; U.S. Pat. No. 5,219,159 issued Jun. 15, 1993 to M. Malachowski, et al; U.S. Pat. No. 5,169,140 issued Dec. 8, 1992 to S. Wenthe; and U.S. Pat. No. 5,697,608 issued Dec. 16, 1997 to V. Castelli, et al. Also, IBM U.S. Pat. No. 4,511,242 issued Apr. 16, 1985 to Ashbee, et al.

The present sheet handling system can also be used with many of these other deskewing systems.

Note that in some reproduction situations, it may even be desired to deliberately provide a substantial, but controlled, sheet side-shift, varying with the sheet's lateral dimension, even for sheets that do not enter the system skewed, such as in feeding sheets from a reproduction apparatus with a side registration system into a connecting finisher having a center registration system. Or, in duplex printing, for providing appropriate or desired side edge margins on the inverted sheets being recirculated for their second side printing after their first side printing. The present system can also be utilized in combination with those other sheet side-shifting systems, which may be generally encompassed by the term "sheet deskewing system" or "skew correction system" as used in the claims herein.

Merely as examples of the variety and range of even standard sheet sizes used in printing and other reproduction systems, in addition to well-known standard sizes with common names such as "letter" size, "legal" size, "foolscap," "ledger" size, A-4, B-4, etc., there are very large standard sheets of uncut plural such standard sizes, such as 14.33 inch (36.4 cm) wide sheets, which are 20.5 inches (52 cm) long, or even larger sheets. Such very large sheets may be used, for example, for single image engineering drawings, or printed "4-up" with 4 letter size images printed thereon per side, and then sheared or cut into four letter size sheets, thus quadrupling the effective PPM printing or throughput rate of the reproduction apparatus, and/or folded into booklet, Z-fold, or map pages. The disclosed system can provide a printer with accurate sheet to image registration by effectively handling even such very long sheets, although that is not mandatory or a claim limitation. Yet the same system here can also effectively handle very much smaller sheets such as 5.5 inch (14 cm) by 7 inch (17.8 cm) or 7 inch (17.8 cm) by 10 inch (25.4 cm) sheets. Some other common standard sheet sizes are listed and described in the table below.

TABLE

Common Standard Commercial Paper Sheet Sizes

| Size Description | Size in Inches | Size in Centimeters |
|---|---|---|
| 1. U.S. Government (old) | 8 × 10.5 | 20.3 × 26.7 |
| 2. U.S. Letter | 8.5 × 11 | 21.6 × 27.9 |
| 3. U.S. Legal | 8.5 × 13 | 21.6 × 33.0 |
| 4. U.S. Legal | 8.5 × 14 | 21.6 × 35.6 |
| 5. U.S. Engineering | 9 × 12 | 22.9 × 30.5 |
| 6. ISO* B5 | 6.93 × 9.84 | 17.6 × 25.0 |
| 7. ISO* A4 | 8.27 × 11.69 | 21.0 × 29.7 |
| 8. ISO* B4 | 9.84 × 13.9 | 25.0 × 35.3 |
| 9. Japanese B5 | 7.17 × 10.12 | 18.2 × 25.7 |
| 10. Japanese B4 | 10.12 × 14.33 | 25.7 × 36.4 |

*International Standards Organization

A specific feature of the specific embodiments disclosed herein is to provide a printing system having a sheet transport system for moving print media sheets in a process direction from upstream to downstream in a sheet transport path, and a sheet lateral registration system in said sheet transport path downstream of said sheet transport system providing for movement of said sheets laterally of said process direction, wherein said print media sheets have a wide range of different sheet dimensions in said process direction to be accommodated by said sheet lateral registration system, wherein said sheet transport system comprises a plurality of sheet transport units having sheet feeding nips, said sheet transport units being spaced from one another and from said sheet lateral registration system from upstream to downstream along said sheet transport path, each of said sheet transport units having sheet feed rollers providing said sheet feeding nips and a drive system for rotationally driving said sheet feed rollers, said sheet feeding nips of said plurality of sheet transport units being engageable with a sheet being fed in said process direction in said sheet transport path for positively feeding said sheet downstream in said sheet transport path from one said sheet transport unit to another said sheet transport unit and from a downstream one of said sheet transport units to said sheet lateral registration system, each of said plurality of sheet transport units being selectably independently operable by rotation of said sheet feed rollers by said drive system thereof to release said sheet by opening said sheet feeding nips thereof and to positively engage said sheet for feeding said sheet downstream by closing said sheet feeding nips thereof; a sheet length signaling system providing a sheet length control signal proportional to said variable dimension of said sheet in said sheet transport path, a control system for automatically so operating a selected plurality of said sheet transport units by opening said sheet feeding nips thereof in response to said sheet length control signal when said sheet is in said sheet lateral registration system, said sheet feed rollers of said plural sheet transport units having at least two different circumferential lengths of at least two different roller radii, comprising first and larger circumferential lengths with larger radii and second and smaller circumferential lengths with smaller radii, said control system providing selective rotations of said sheet feed rollers of selected said sheet transport units to selectively provide, by selected partial rotations of said sheet feed rollers, a first operating mode of closed sheet feeding nips with said first and larger circumferential lengths with larger radii, and a second operating mode with said second and smaller circumferential lengths with smaller radii to provide open nips for said selected sheet transport units providing unobstructed sheet lateral movement therein by said sheet lateral registration system.

Further specific features disclosed herein, individually or in combination, include those wherein there are at least three said selectably actuated sheet transport units spaced along said sheet transport path upstream of said sheet lateral registration system; and/or wherein said first and larger circumferential lengths with larger radii of said sheet feed rollers of said plural sheet transport units are circumferential lengths which are equal to or greater than said spacing of said plural sheet transport units along said sheet transport path upstream of said sheet lateral registration system; and/or a sheet feeding and registration system for positive feeding print media sheets in a process direction from upstream to downstream in a sheet transport path containing a sheet lateral registration system providing selective movement of said same sheets laterally of said process direction, wherein said print media sheets have a wide range of different sheet dimensions in said process direction to be accommodated by said sheet lateral registration system, comprising a plurality of sets of rotatably driven sheet feed rollers defining sheet feeding nips are spaced from one another along said sheet transport path to provide said sheet feeding, said sheet feed rollers of said plural sets thereof having at least two different circumferential lengths of at least two different roller radii, comprising first and larger circumferential lengths with larger radii and second and smaller circumferential lengths with smaller radii, a sensing system for sensing the length of a sheet to be laterally registered by said sheet lateral registration system, a rotational drive system for selective rotations of said sheet feed rollers of selected said sets thereof in response to said sensing of the length of a sheet to be laterally registered to provide, in selected partial rotations of selected said sets of said sheet feed rollers, a first operating mode of closed sheet feeding nips with said first and larger circumferential lengths with larger radii for said sheet feeding, and a second operating mode with said second and smaller circumferential lengths with smaller radii to provide open nips for unobstructed sheet lateral movement therein by said sheet lateral registration system; and/or a sheet feeding and registration method for positive feeding print media sheets in a process direction from upstream to downstream in a sheet transport path integrated with sheet lateral registration by selective movement of said same sheets laterally of said process direction, wherein said print media sheets have a wide range of different sheet dimensions in said process direction to be accommodated by said sheet lateral registration, wherein said sheet feeding is provided by a plurality of sets of rotatably driven sheet feed rollers defining sheet feeding nips spaced from one another along said sheet transport path, said sheet feed rollers of said plural sets of rotatably driven sheet feed rollers having at least two different circumferential lengths of at least two different roller radii, comprising first and larger circumferential lengths with larger radii and second and smaller circumferential lengths with smaller radii, sensing the length of a sheet to be provided with said sheet lateral registration, providing selective rotations of said sheet feed rollers of selected said sets thereof in response to said sensing of the length of a sheet to provide in selected partial rotations of said sheet feed rollers a first operating mode of closed sheet feeding nips with said first and larger circumferential lengths with larger radii for said sheet feeding, and a second operating mode with said second and smaller circumferential lengths with smaller radii providing open nips for unobstructed sheet lateral movement therein by said sheet lateral registration system; and/or wherein said selective rotations of said sheet feed rollers are by a single motor for each said set thereof which provides both said sheet feeding and said selective open and closed nips thereof.

As is taught by the above-cited and other references, the disclosed system may be operated and controlled as described herein by appropriate operation of known or conventional control systems. It is well known and preferable to program and execute printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or VLSI designs.

It is well known in the art that the control of sheet handling systems may be accomplished by conventionally actuating them with signals from a microprocessor controller directly or indirectly in response to programmed commands and/or from selected actuation or non-actuation of conventional switch inputs or sensors. The resultant controller signals may conventionally actuate various conventional electrical servo or stepper motors, clutches, or other components, in programmed steps or sequences.

In the claims herein the term "sheet," "copy," or "copy sheet" refers to a usually flimsy physical sheet of paper, plastic, or other suitable physical substrate for images, whether precut or initially web fed and cut. Likewise the terms lateral registration or sheet side shifting as used in the claims herein encompasses sheet deskewing, or sheet lateral side-shifting without deskewing, or both, unless otherwise specifically indicated. The terms "printer," "printing system," or "reproduction system" as used herein encompass any type of printer, copier or multi-functional device which may utilize the claimed features.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
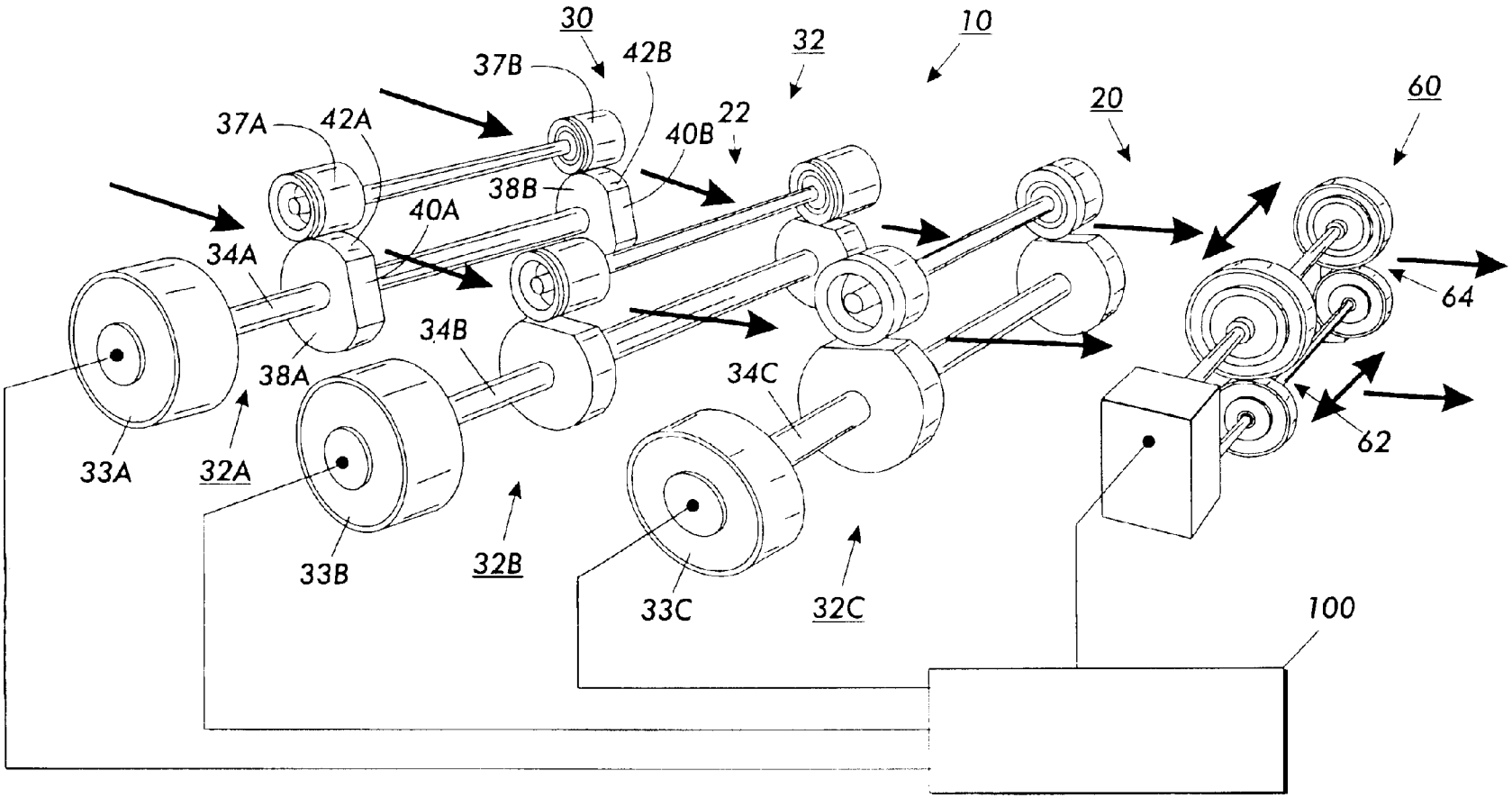

Various of the above-mentioned and further features and advantages will be apparent from the specific apparatus and its operation described in the specific example below. Thus, the present invention will be better understood from this description of this specific exemplary embodiment, including the drawing figures (approximately to scale) wherein:

FIG. 1 is a schematic front view of one embodiment of the subject improved sheet transport and lateral registration system providing the capability of feeding and registering a wide range of different sheet sizes; and FIG. 2 is an enlarged schematic and simplified perspective view of the exemplary sheet path feed rollers and their drives of the exemplary system embodiment of FIG. 1.

Described now in further detail, with reference to the Figs., is one exemplary embodiment. There is shown in FIG. 1 one example of a reproduction machine 10 comprising a high speed xerographic printer merely by way of one example of various possible printing applications of the exemplary improved integral sheet transport and lateral registration system.

As noted above, further details of suitable examples of sheet lateral registration systems per se are already taught in the above-cited and other TELER patents, and the above cross-referenced co-pending application of the same inventors. Alternative sheet lateral registrations systems are also taught in the above-cited U.S. Pat. Nos. 6,168,153, 5,678,159, or 5,715,514, and other cited art. Hence, such lateral registration systems per se need not be re-described in detail here, and the sheet deskewing and side registration system 60 schematically shown and described herein is merely exemplary thereof. Note the lateral movement thereof indicated by the lateral movement arrow.

In this disclosed example, the prior art complex nip opening mechanisms to allow such lateral sheet registration movement are eliminated. The plural sheet drive nips of the paper path may comprise otherwise conventional drive rolls and mating idlers. The drive rolls are provided with a "flat" or reduced radius area that interrupts the drive roll nip-forming cylindrical circumference. The mating idler may remain completely cylindrical, and need not be moved to open the nip. When the flat of the drive roller is driven by its regular rotational drive system into a position facing the idler, the nip is automatically opened, there by allowing the sheet registration device to orient the paper. This simplified design reduces parts, costs, power consumption, noise, and linkage or cable adjustments. Also, by reducing delays in nip openings with this simplified system, faster sheet handling and increased time for sheet registration can be provided. That is, this system accommodates higher printing speeds by eliminating any solenoid reaction time. Also, a larger and clearly unobstructing or lower friction nip opening can be provided.

Providing appropriately positioned and dimensioned drive rollers with a reduced radius portion selectably facing their respective idlers to provide appropriately opened nip allows the sheet registration systems to deskew and top edge adjust variable sizes of sheets. The drive rollers may be sized such that the circumference of the drive roller exceeds the distance between nips. In operation the first drive nip set may, for example, upon sensing an incoming sheet, rotate 360 degrees to feed the sheet to the next downstream nip set and then stop with the flat orientated toward the idler. Prior to that nip opening the next nip set may engage the same sheet and drive it in turn on to the next nip. This would continue until the sheet reached the registration system nips. For example, such nip sets may be spaced about 120 mm along the sheet path. During the registration function all the nips may be in the open orientation, or, for smaller sheets, the upstream nips may be rotating to feed the next sheets, as will be described. Each nip set may be individually stepper motor or servo-motor driven, and may have a "home" sensing ability to orient the flat portion.

Referring now to FIG. 1 in particular, in this exemplary printer 10, sheets 12 (print media image substrates) to be printed may be otherwise conventionally fed through an overall paper path 20. Clean sheets to be printed may be conventionally fed from a sheet feeder/separator into a sheet input 21, which also conventionally has a converging or merged path entrance from a duplexing sheet return path 23. Sheets inputted from either input 21 or 23 are fed downstream here in an elongated, generally planar, sheet input path 22. The sheet input path 22 here is a portion of the overall paper path 20. The overall paper path 20 here also conventional includes the duplexing return path 23, and a sheet output path 24 downstream from an image transfer station 25, with an image fuser 27 in the sheet output path. The transfer station 25, for transferring developed toner images from the photoreceptor 26 to the sheets 12, is downstream from the sheet input path 22.

As will be described in detail herein, in this embodiment this sheet input path 22 contains an example of a sheet deskewing and side registration system 60. This system 60 is desirably combined with the operation of a subject upstream sheet feeding system 30 having a variable sheet feeding nips engagement system 32.

Describing first the subject exemplary sheet registration input system, referred to herein as the upstream sheet feeding system 30, its variable nips engagement system 32 here comprises three identical plural feed roller nip units 32A, 32B and 32C, respectively, spaced along the sheet input path 22 in the sheet feeding or process direction, as shown in FIGS. 1 and 2, by relatively short distances therebetween capable of positively feeding the smallest desired sheet 12 downstream from one said unit 32A, 32B, 32C to another, and then from the nips of the last said unit 32C to the nips of the sheet deskewing and side registration system 60. Each said identical unit 32A, 32B, 32C, as especially shown in FIG. 2, has one stepper or servo motor 33A, 33B, 33C, respectively, each of which is controllably rotating a single drive shaft 34A, 34B, 34C under the control of a controller 100.

Since all three spaced units 32A, 32B, 32C may be identical in structure (that is, identical except for their respective input control signals to their respective motors 33A, 33B, 33C from the controller 100, to be described), only one said unit 32A, the furthest upstream, need now be described, with reference especially to FIG. 2. The shaft 34A thereof extends transversely across the paper path 22 and has two laterally spaced identical, sheet drive rollers 38A, 38B positioned on the drive shaft 34A. These sheet drive rollers 38A, 38B rotatably engage with opposingly mounted fixed axis idler wheels 37A, 37B to form sheet feeding nips to feed sheets 12 of various widths.

These sheet drive rollers 38A, 38B here are not fully cylindrical, like normal sheet feed rollers. Rather, the rollers 38A, 38B have identical minor reduced radius areas 40A and 40B, which may be called "flats" for convenience, but need not be, as well as major, normal, larger radius, cylindrical areas 42A and 42B. When the rollers 38A, 38B are rotated by their motor 33A so that their cylindrical areas 42A and 42B face their idlers 37A, 37B they engage to form normal sheet feeding closed nips, as shown in FIG. 2. But when the rollers 38A, 38B are rotated by the motor 33A so that their reduced radius areas 40A and 40B face their idlers 37A, 37B, then they automatically effectively disengage to form open (non-feeding) nips allowing unobstructed lateral movement of any sheet in those open nips. In FIG. 2 the otherwise corresponding nips of units 32B and 32C are shown so-opened for illustrating this difference.

The stepper motor 33A or its connecting shaft may have a conventional "home position" sensor, and may be conventionally rotated by the desired amount or angle to and from a "home position" by application of the desired number of step pulses by controller 100.

For the variable operation of the upstream variable nip engagement sheet feeding system 32, the three sheet feeding units 32A, 32B, 32C are differently actuated by the controller 100 depending on the length in the process direction of the sheet they are to feed downstream to the deskew and side registration system 60. A sheet length control signal is provided in or to the controller 100. That sheet length control signal may be from a conventional sheet length sensor such as 102 in FIG. 1 measuring the sheet 12 transit time in the sheet path between trail edge and lead edge passage of the sheet 12 past the sensor 102. That sensor may be mounted, for example, in or upstream of the sheet input 21. Alternatively, sheet length signal information may already be provided in the controller from operator input or sheet feeding tray or cassette selection, or sheet stack loading therein, etc.

That sheet length control signal is then processed in the controller 100 to determine which of the three motors 33A, 33B, 33C, if any, of the three units 32A, 32B, 32C spaced along the sheet feeding path 22 will be actuated for that particular sheet or sheets 12 to open or close the respective sheet feeding nips of the three units. All of them may be utilized for positive sheet feeding until the sheet 12 is acquired in the nips 62, 64 of the sheet lateral registration system 60. That insures positive nip sheet feeding of even very small sheets along the entire sheet path 22 up to the lateral registration system 60.

For the shortest sheets, once the sheet is acquired in the steering nips 62, 64 of the deskew and side registration system 60, then only the most downstream unit 32C motor 33C need be rotated or stopped in its open nip position in order to release that small sheet 12 from any and all sheet feeding nips upstream of the registration unit 60, thus allowing the unit 60 to freely side shift and/or deskew that small sheet. This is illustrated by the lateral movement arrows in FIG. 2. However, concurrently keeping the two other, further upstream, sheet feeding nip sets closed in those two further upstream units 32A, 32B allows subsequent such small sheets to be positively fed downstream in the same input path 22 closely following the preceding released sheet 12.

However, for an intermediate length sheet, the trailing end area of the sheet 12 will still be in the nip set of the intermediate sheet feeding unit 32B when its leading edge area reaches the nips of the lateral registration system 60. Thus, when the sensor 102 or other sheet length signal indicates such an intermediate sheet length being fed in the sheet input path 22, then both units 32B and 32C are automatically actuated as described to disengage their nip sets at that point in time.

In further contrast, when a very long sheet is detected and/or signaled in the sheet input path 22, then when the lead edge of that long sheet has reached and is under feeding control of the deskewing and side registration system 60, all three units 32A, 32B, 32C are automatically actuated by the controller 100 to open all their sheet feeding nips to allow that very long sheet to be side registered and/or deskewed by allowing lateral movement of that sheet in the sheet feeding nips of all three units along the upstream sheet path 22.

It will be appreciated that if an even greater range of sheet lengths is desired to be reliably input fed and deskewed and/or side registered (either clean new sheets or sheets already printed on one side being returned by the duplex loop return path 23 for re-registration before second side printing), that the system 30 can be modified by increasing the number of such spaced sheet feeding units, and separately actuated depending on sheet length as described above. The added units may be spaced upstream by the same small-sheet inter-unit spacing as is already provided for positively feeding the shortest desired sheet between each of units 32A, 32B, and 32C. Likewise, if only a smaller range of sheet sizes is to be handled, there could be a system with only two units, 32B and 32C. In any version, the system 32 lends itself to enabling increased productivity for smaller sheets, as well as handling much larger sheets, without skipped pitches.

As another alternative version of the system 32, instead of waiting until the lead edge of a sheet reaches the deskew system 60 before opening the nips of any of the units 32A, 32B and 32C, the nips of each respective unit can be opened in sequence (instead of all at once) as the sheet being fed by one unit is acquired in the closed nips of the next downstream unit. The number of units needed to be held open to allow deskewing of long sheets will be the same described above, and the other units may have their nips re-closed for feeding in the subsequent sheet.

The system 60 may be provided as described various in the above-cited U.S. patents and connect to the same controller 100 to provide differential sheet steering control signals for deskewing and/or side registering the sheet 12 in the system 60 and thus need not be re-described herein.

After the sheet 12 has been side registered and/or deskewed in the system 60 it may be fed directly into the fixed, commonly driven, nip set of a downstream pre-transfer nip assembly unit 80. That unit 80 here feeds the sheet into the image transfer station 25. This unit 80 may also share essentially the same hardware as the three upstream sheet feeding units. Once the sheet 12 as been fed far enough on by the unit 80 to the position of the maximum tack point of electrostatic adhesion to the photoreceptor 26 within the transfer station 25, the nips of the unit 80 may be automatically opened in a similar manner so that the photoreceptor 26 will control the sheet 12 movement at that point. Alternatively, the sheet may be fed directly from the unit 60 into the photoreceptor image transfer station 25, eliminating the unit 80.

As to all of the units and their nip sets in the entire described input paper path, all of the nips may be automatically opened by appropriate rotation of all the motors for ease of sheet jam clearance or sheets removal from the entire path in the event of a sheet jam or a machine hard stop due to a detected fault.

Note that all the drive rollers and idlers in the sheet path 22 here can be desirably conventionally mounted and driven on fixed axes at fixed positions in the paper path. The drive rollers may all be of the same material, e.g., urethane rubber, and likewise the idler rollers may all be of the same material, e.g., polycarbonate plastic, or a harder urethane.

It will be appreciated that such "D" shaped sheet drive rollers 38A, 38B may desirably have a larger radius than conventinal drive rolls so that only one (partial) revolution of the full radius portions 42A, 42B of the roller circumference will positively feed the shortest sheet being fed into the next downstream sheet feeding nip or other positive acquisition. That is, the circumference of full radius portions 42A, 42B must be longer than the distance between its own nip and the next downstream nip. Otherwise the nips will open from the rotation of the rollers 42A, 42B reaching their small radius portions 40A, 40B. This may require larger radius rollers 42A, 42B than normal. To express it another way, plural revolutions cannot be used for that function as in the prior art fully cylindrical sheet feed rollers. Thus, in a high speed system, it may be desirable to design such larger radius "D" shaped rollers with a lower moment of rotational interia and angular momentum by conventional designs and/or lower density outer materials therefor.

While the embodiments disclosed herein are presently preferred, it will be appreciated that other presently unknown or unforeseeable alternatives, modifications, variations or improvements therein may be made by those skilled in the art, which are intended to be encompassed by the following claims.

What is claimed is:

1. A printing system having a sheet transport system for moving print media sheets in a process direction from upstream to downstream in a sheet transport path, and a sheet lateral registration system in said sheet transport path downstream of said sheet transport system providing for movement of said sheets laterally of said process direction, wherein said print media sheets have a wide range of different sheet dimensions in said process direction to be accommodated by said sheet lateral registration system, wherein said sheet transport system comprises a plurality of sheet transport units having sheet feeding nips, said sheet transport units being spaced from one another and from said sheet lateral registration system from upstream to downstream in said process direction along said sheet transport path, each of said sheet transport units having sheet feed rollers providing said sheet feeding nips and a drive system for rotationally driving said sheet feed rollers in said process direction, said sheet feeding nips of said plurality of sheet transport units being engageable with a sheet being fed in said process direction in said sheet transport path for positively feeding said sheet downstream in said sheet transport path from one said sheet transport unit to another said sheet transport unit and from a downstream one of said sheet transport units to said sheet lateral registration system, each of said plurality of sheet transport units being selectably independently operable by rotation of said sheet feed rollers in said same process direction by said drive system thereof to release said sheet by opening said sheet feeding nips thereof and to positively engage said sheet for feeding said sheet downstream by closing said sheet feeding nips thereof;

a sheet length signaling system providing a sheet length control signal proportional to said variable dimension of said sheet in said sheet transport path, a control system for automatically so operating a selected plurality of said sheet transport units by opening said sheet feeding nips thereof in response to said sheet length control signal when said sheet is in said sheet lateral registration system, said sheet feed rollers of said plural sheet transport units having at least two different circumferential lengths of at least two different roller radii, comprising first and larger circumferential lengths with larger radii and second and smaller circumferential lengths with smaller radii, said control system providing selective rotations of said sheet feed rollers of selected said sheet transport units to selectively provide, by selected partial rotations of said sheet feed rollers, a first operating mode of closed sheet feeding nips with said first and larger circumferential lengths with larger radii, and a second operating mode with said second and smaller circumferential lengths with smaller radii to provide open nips for said selected sheet transport units providing unobstructed sheet lateral movement therein by said sheet lateral registration system.

2. The printing system of claim 1 wherein there are at least three said selectably actuated sheet transport units spaced along said sheet transport path upstream of said sheet lateral registration system.

3. The printing system of claim 1 wherein said first and larger circumferential lengths with larger radii of said sheet feed rollers of said plural sheet transport units are circumferential lengths which are equal to or greater than said spacing of said plural sheet transport units along said sheet transport path upstream of said sheet lateral registration system.

4. A sheet feeding and registration system for positive feeding print media sheets in a process direction from upstream to downstream in a sheet transport path containing a sheet lateral registration system providing selective movement of said same sheets laterally of said process direction, wherein said print media sheets have a wide range of different sheet dimensions in said process direction to be accommodated by said sheet lateral registration system, comprising;

a plurality of sets of rotatably driven sheet feed rollers defining sheet feeding nips are spaced from one another along said sheet transport path in said process direction to provide said sheet feeding, said sheet feed rollers of said plural sets thereof having at least two different circumferential lengths of at least two different roller radii, comprising first and larger circumferential lengths with larger radii and second and smaller circumferential lengths with smaller radii, a sensing system for sensing the length of a sheet to be laterally registered by said sheet lateral registration system, a rotational drive system for selective rotations of said sheet feed rollers of selected said sets thereof in response to said sensing of the length of a sheet to be laterally registered to provide, in selected partial rotations of selected said sets of said sheet feed rollers in said process direction, a first operating mode of closed sheet feeding nips with said first and larger circumferential lengths with larger radii for said sheet feeding in said process direction, and a second operating mode with said second and smaller circumferential lengths with smaller radii to provide open nips for unobstructed sheet lateral movement therein by said sheet lateral registration system.

5. A sheet feeding and registration method for positive feeding print media sheets in a process direction from upstream to downstream in a sheet transport path integrated with sheet lateral registration by selective movement of said same sheets laterally of said process direction, wherein said print media sheets have a wide range of different sheet dimensions in said process direction to be accommodated by said sheet lateral registration, wherein;

said sheet feeding is provided by a plurality of sets of rotatably driven in said process direction sheet feed rollers defining sheet feeding nips spaced from one another along said sheet transport path, said sheet feed rollers of said plural sets of rotatably driven sheet feed rollers having at least two different circumferential lengths of at least two different roller radii, comprising first and larger circumferential lengths with larger radii and second and smaller circumferential lengths with smaller radii, sensing the length of a sheet to be provided with said sheet lateral registration, providing selective rotations in said process direction of said sheet feed rollers of selected said sets thereof in response to said sensing of the length of a sheet to provide in selected partial rotations of said sheet feed rollers in said process direction in a first operating mode of closed sheet feeding nips with said first and larger circumferential lengths with larger radii for said sheet feeding in said process direction, and a second operating mode with said second and smaller circumferential lengths with smaller radii providing open nips for unobstructed sheet lateral and process direction movement therein by said sheet lateral registration system.

6. The sheet feeding and registration method of claim 5 wherein said selective rotations of said sheet feed rollers are by a single motor for each said set thereof which provides both said sheet feeding and said selective open and closed nips thereof.

* * * * *